US007794114B2

(12) United States Patent
Medendorp, Jr.

(10) Patent No.: US 7,794,114 B2
(45) Date of Patent: Sep. 14, 2010

(54) METHODS AND APPARATUS FOR IMPROVED HEAT SPREADING IN SOLID STATE LIGHTING SYSTEMS

(75) Inventor: Nicholas W. Medendorp, Jr., Raleigh, NC (US)

(73) Assignee: Cree, Inc., Durham, NC (US)

( * ) Notice: Subject to any disclaimer, the term of this patent is extended or adjusted under 35 U.S.C. 154(b) by 0 days.

(21) Appl. No.: 11/548,357

(22) Filed: Oct. 11, 2006

(65) Prior Publication Data

US 2008/0089069 A1 Apr. 17, 2008

(51) Int. Cl.
*F21V 23/00* (2006.01)

(52) U.S. Cl. ..... 362/294; 362/249.02; 362/373; 362/545; 361/508; 361/713

(58) Field of Classification Search ..... 362/294, 362/227, 240, 373, 545–547, 609, 800, 812; 361/702, 703, 705, 708, 709, 712, 713, 717–721; 313/498, 500, 512; 257/678, 701–703, 705–707, 257/717, 719, 720
See application file for complete search history.

(56) References Cited

U.S. PATENT DOCUMENTS

| | | | | |
|---|---|---|---|---|
| 5,924,785 | A | 7/1999 | Zhang et al. | |
| 6,482,520 | B1 | 11/2002 | Tzeng | |
| 6,578,998 | B2 | 6/2003 | Zhang | |
| 6,614,103 | B1 | 9/2003 | Durocher et al. | |
| 6,733,711 | B2 * | 5/2004 | Durocher et al. | 264/272.14 |
| 6,746,768 | B2 | 6/2004 | Greinke et al. | |
| 7,001,047 | B2 | 2/2006 | Holder et al. | |
| 7,114,831 | B2 | 10/2006 | Popovich et al. | |
| 7,131,760 | B2 | 11/2006 | Mayer et al. | |
| 7,213,940 | B1 | 5/2007 | Van De Ven et al. | |
| 7,246,921 | B2 | 7/2007 | Jacobson et al. | |
| 7,374,311 | B2 | 5/2008 | Rains, Jr. et al. | |
| 7,505,109 | B2 * | 3/2009 | Cheng et al. | 349/161 |
| 2003/0116312 | A1 * | 6/2003 | Krassowski et al. | 165/185 |
| 2005/0166158 | A1 | 7/2005 | Blanchard, III et al. | |
| 2005/0190553 | A1 * | 9/2005 | Lynch et al. | 362/227 |
| 2005/0225222 | A1 * | 10/2005 | Mazzochette et al. | 313/46 |
| 2006/0081773 | A1 | 4/2006 | Rains, Jr. et al. | |
| 2006/0087866 | A1 * | 4/2006 | Ng et al. | 362/612 |
| 2006/0098438 | A1 * | 5/2006 | Ouderkirk et al. | 362/294 |
| 2007/0053205 | A1 * | 3/2007 | Jang et al. | 362/609 |
| 2007/0076422 | A1 * | 4/2007 | Nicolai | 362/547 |
| 2007/0102142 | A1 * | 5/2007 | Reis et al. | 165/80.3 |
| 2007/0103875 | A1 * | 5/2007 | Reis et al. | 361/719 |
| 2007/0139895 | A1 * | 6/2007 | Reis et al. | 361/719 |
| 2007/0230183 | A1 | 10/2007 | Shuy | |
| 2007/0242441 | A1 | 10/2007 | Aldrich et al. | |
| 2008/0103714 | A1 | 5/2008 | Aldrich et al. | |

FOREIGN PATENT DOCUMENTS

| | | | |
|---|---|---|---|
| JP | 2005340101 A | * | 12/2005 |
| WO | WO 2007037605 A1 | * | 4/2007 |

* cited by examiner

*Primary Examiner*—Hargobind S Sawhney
(74) *Attorney, Agent, or Firm*—Priest & Goldstein, PLLC

(57) ABSTRACT

A solid state lighting subassembly or fixture includes an anisotropic heat spreading material. A heat spreading layer may be placed between a light emitting diode (LED) and luminaire or reflector and serves to spread heat laterally away from the LED. Low profile, low weight heat spreading may be utilized both to retrofit existing light fixtures with LEDs or to replace existing incandescent and fluorescent fixtures with LED based fixtures.

20 Claims, 5 Drawing Sheets

METHODS AND APPARATUS FOR IMPROVED HEAT SPREADING IN SOLID STATE LIGHTING SYSTEMS

FIELD OF THE INVENTION

The present invention relates generally to improvements to solid state based lighting methods and apparatus suitable for use in both retrofitting and replacing existing fluorescent lighting systems and the like. More particularly, it relates to advantageous methods and apparatus for improved heat spreading and heat management in light emitting diode (LED) lighting systems.

BACKGROUND OF THE INVENTION

LED lighting systems are becoming more prevalent as replacements for existing lighting systems. LEDs are an example of solid state lighting and are superior to traditional lighting solutions such as incandescent and fluorescent lighting because they use far less energy, are far more durable, operate longer, can be combined in red-blue-green arrays that can be controlled to deliver virtually any color light, and contain no lead or mercury. As LEDs replace the typical fluorescent light fixtures found in many workplaces, the present invention recognizes that it is important to cost effectively dissipate the heat generated by the LEDs used in these systems while enabling relatively simple physical retrofitting or replacement of existing lighting hardware.

One common fluorescent lighting fixture is a luminaire fixture 100 shown illustratively in FIG. 1. Fixture 100 may suitably comprise a 2' by 4' metal box or compartment 102 having a plurality of fluorescent bulbs 104, 106 and 108. While a 2' by 4' fluorescent fixture is discussed here as exemplary, it will be recognized that many other sizes of fluorescent fixture and various incandescent fixtures are also common. Each fluorescent bulb, such as bulb 108, is inserted in an electrical socket, and located within a reflective subassembly 210 as seen in greater detail in FIG. 2. The compartment 102 also has a reflective back surface, such as a white painted interior surface and a plastic cover mounted in a hinged door (not shown) which swings open to allow the bulbs to be easily accessed and changed. Such a fixture with its electrical ballasts may weigh about 40 pounds. A typical office may have several such fixtures mounted to the ceiling of each room to provide room lighting.

A ceiling mounted fluorescent bulb, such as the bulbs 104, 106 and 108, is only about 50-60% efficient in directing its light downwards to the room below. As illustrated by FIG. 2, if a single ceiling mounted fluorescent bulb 108 in a typically reflective luminaire or reflector 210 is considered to emit light from four quadrants A, B, C, and D, for example, about 30% of the light emitted from quadrant A reaches a room below, about 55% from quadrants B and C is directed downwards and almost 95% from quadrant D is directed downwards so that the end result is approximately 50-60% efficiency. By contrast, a plurality of LEDs 300 mounted in a similar reflective fixture 310 direct most of their light downward to the room below.

With respect to heat dissipation, the fluorescent bulbs 102, 106 and 108 extend the length of box 102 as indicated by the dashed lines for their subassemblies in FIG. 1. With their large surface areas, they very effectively transfer their heat to the surrounding air and subassemblies so that heat dissipation is not a problem for fluorescent lighting fixtures of this kind. By contrast, when a fluorescent bulb is replaced by a series of high power LEDs, such as the LEDs 300 of FIG. 3, as represented by xs in FIG. 1, heat dissipation becomes an issue. In this example, high power means an LED having a current of 125 mA or higher. In most cases, power LEDs for lighting applications will be mounted on metal core printed circuit boards (MCPCB), which will be thermally connected to an isotropic heat sink. Heat flows through the MCPCB to the heat sink by way of conduction. The heat sink diffuses heat to the ambient surroundings by convection. There are three common varieties of heat sinks: flat plates, dip-cast finned heat sinks, and extruded finned heat sinks. A material often used for heat sink construction is aluminum, although copper may be advantageously used for flat-sheet heat sinks.

One approach to heat dissipation is to use a large multi-vaned or multifinned aluminum heat sink, such as heat sink 320 seen in FIG. 3. Such a heat sink may not be practical in a luminaire fixture retrofit for a number of reasons. A typical 2' by 4' fluorescent luminaire light fixture, such as the fixture 100, shown in FIG. 1, may weigh approximately 40 pounds and its top surface 112 mounts flush with the ceiling of the room in which it is to be utilized. By contrast, if one heat sink 320 weighs approximately 8 pounds, then the use of three additional heat sinks 320 would add about 24 pounds to the weight of fixture 100. If the cost of each heat sink 320 is about \$40-\$50 with shipping from the supplier costing more than \$10, then the increased total cost may be prohibitive to many potential purchasers. Additionally, the heat sink would have to be mounted recessed into the ceiling for an LED-based fixture to be mounted flush with the ceiling in a manner compatible with the present mount typical of fluorescent fixtures, such as the 100. Thus, such an approach would not provide a particularly cost effective or physically compatible retrofit with existing fluorescent luminaire light fixtures.

With respect to newly designed LED lighting fixtures having different form factors from standard lighting LED fixtures, there still may be issues with respect to satisfactory dissipation of heat from one or more high power LEDs or even from lower power LEDs where multiple LEDs are employed.

SUMMARY OF THE INVENTION

Among its several aspects, the present invention recognizes that a more cost effective, lower weight, and lower physical profile approach to heat dissipation is highly desirable for solid state fixtures, such as LED-based lighting fixtures intended to replace standard fluorescent lighting fixtures. Important factors in selecting heat sinks include the surface area and weight of the heat sink. An aspect of the present invention balances such important design constraints with the physical constraints of existing lighting fixtures, such as their weight, footprint, profile and the like. Further, the present invention addresses techniques for more efficiently transferring heat away from LEDs to the surrounding metal or other materials of a mounting fixture, such as the reflective metal of a luminaire fixture. By utilizing such materials to dissipate heat more effectively, advantages such as lower overall weight fixtures may be achieved. Further, more effective heat spreading can result in longer LED lifetime and more consistent LED performance. To such ends, an aspect of the present invention seeks to utilize an existing isotropic conductive heat sink or frame of a standard or design fixture thereby allowing more cost effective retrofitting of such devices. Another aspect addresses a better design approach to new design fixtures.

According to one aspect of the invention, a solid state lighting fixtures comprises: a thermally conductive component; a solid state light source for providing room lighting; an anisotropic heat spreader in thermal contact with the solid state light source and the thermally conductive component of the lighting fixture so as to spread heat from the solid state light source in a preferential direction from the solid state light source to said thermally conductive component thereby making said thermally conductive component a more effective heat sink for the solid state light source.

According to another aspect a solid state lighting subassembly comprises: a plurality of light emitting diodes (LEDs); a thermally isotropic mount supporting the plurality of light emitting diodes; and anisotropic material thermally conducting heat from one or more of said plurality of LEDs and the thermally isotropic mount in a preferential direction to more effectively utilize said mount as a heat sink.

A more complete understanding of the present invention, as well as other features and advantages of the invention, will be apparent from the following detailed description, the accompanying drawings, and the claims.

DETAILED DESCRIPTION

Figure 1:
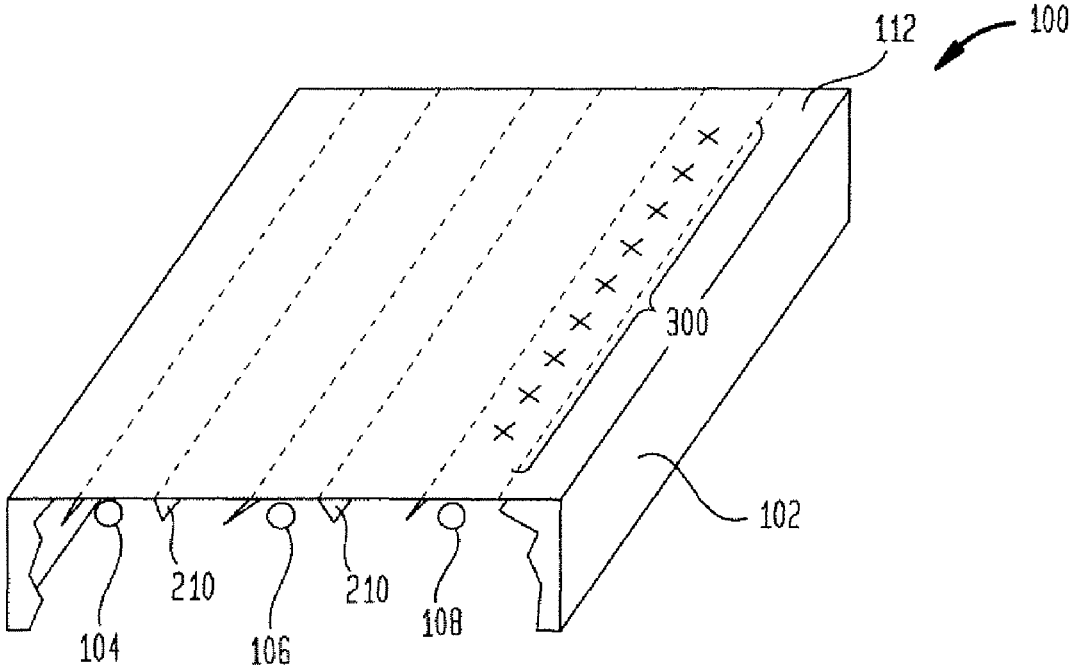
FIG. 1 illustrates aspects of the illumination and heat dissipation of a standard prior art fluorescent lighting fixture.
Figure 2:
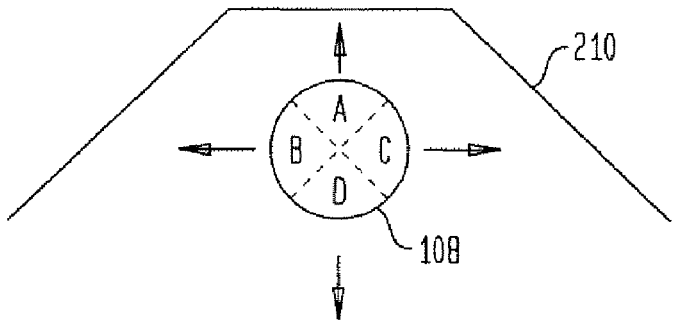
FIG. 2 illustrates approximately how a ceiling mounted fluorescent bulb lights a room below.
Figure 3:
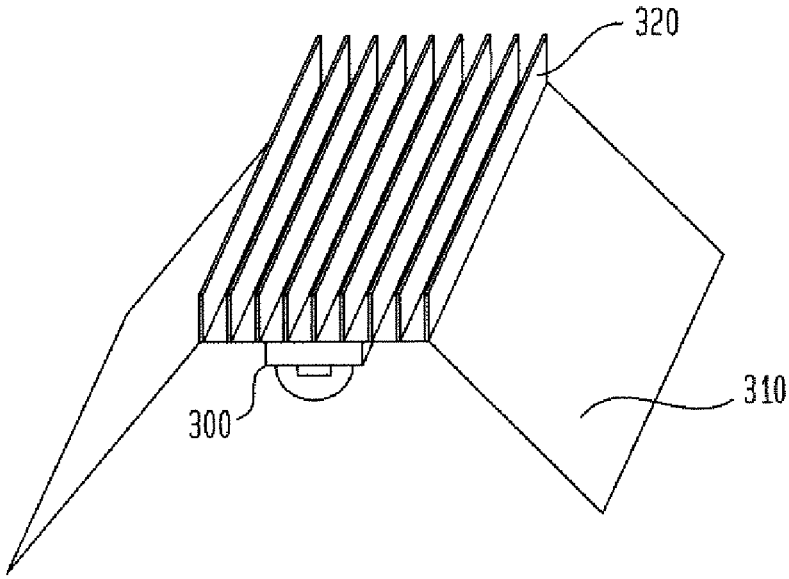
FIG. 3 illustrates aspects of an LED lighting arrangement with an aluminum heat sink.
Figure 4:
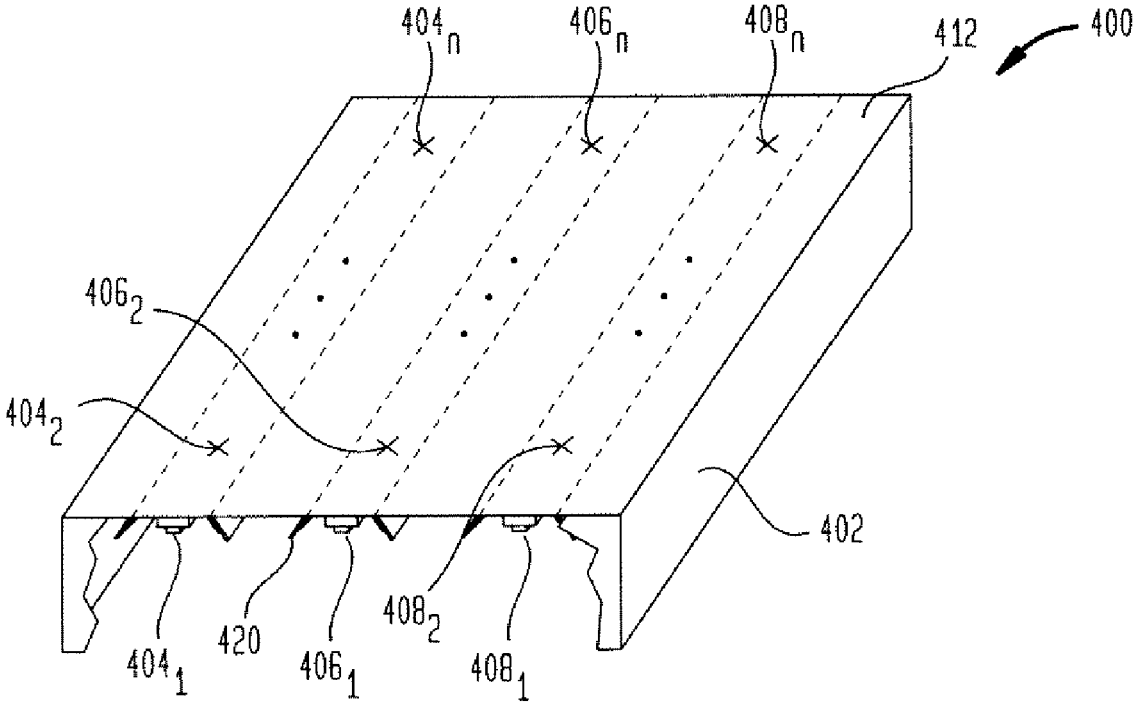
FIG. 4 illustrates a perspective view of a first embodiment of an LED lighting system employing an anisotropic heat spreading material in accordance with the present invention.

FIG. 4 shows a side view of a first embodiment of an LED based light fixture 400 in accordance with the present invention. As shown in FIG. 4, each of the three fluorescent bulbs 104, 106, 108 of FIG. 1 is replaced by a number, n, of LEDs $\mathbf{404}_1$, $\mathbf{404}_2$, . . . $\mathbf{404}_n$ (collectively 404), $\mathbf{406}_1$, $\mathbf{406}_2$, . . . $\mathbf{406}_n$ (collectively 406), and $\mathbf{408}_1$, $\mathbf{408}_2$, . . . $\mathbf{408}_n$ (collectively 408), respectively. While it is presently preferred that high power LEDs, such as XLamp™ series LEDs from Cree, Incorporated, having a current of 125 mA or higher be employed, it will be recognized that lower power LEDs may also be employed. Further exemplary details of suitable mounting details of the LEDs 404, 406 and 408 are shown in FIGS. 5, 6, 9A and 9B. While single LEDs are shown, multiple color LEDs, such as red, blue and green may be grouped together in arrays for applications where it is desired to be able to vary the color of light delivered by the fixture.

Figure 5:
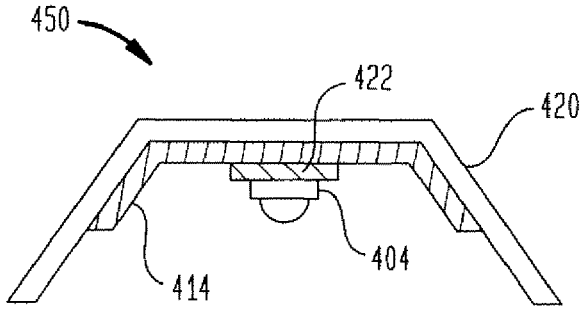
FIG. 5 illustrates a side view of a portion of FIG. 4.
Figure 6:
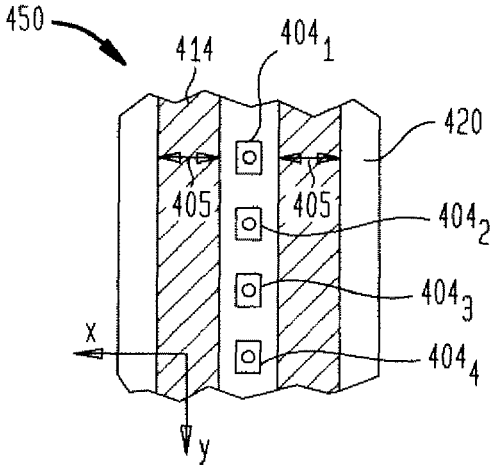
FIG. 6 illustrates a bottom view of the portion of LED lighting system shown in FIG. 5.

In FIGS. 5 and 6, a plurality of LEDs 404 are mounted on a metal core or FR4 board 422 in thermal contact with a sheet of anisotropic heat spreading material 414 which is attached by an adhesive backing, such as a thermal adhesive, glued or otherwise attached to a luminaire or other reflector 420. The combination of LEDs 404, metal core or FR4 board 412, anisotropic heat spreading material 414 and luminaire 420 forms a subassembly 450. An anisotropic heat spreading material is one which preferentially directs heat in one direction. Some exemplary material thermal conductivities are shown in the table below.

| Thermal Conductivity (W/m-K at room temperature) | |
|---|---|
| SiC | 300 |
| AlN | 170-320 |
| $Al_2O_3$ | 35 |
| $SiO_2$ | 1 |
| Diamond | 1000-2000 |
| Cu | 385-405 |
| Graphite | 100-500 (x-y plane) |
| | 5-10 (z direction perpendicular to x-y plane) |
| Al | 205-220 |

Of the listed materials, graphite is anisotropic while the other materials are isotropic. One commercially available anisotropic heat spreading material suitable for use in the present invention is the eGRAF™ Spreader Shield™ adhesive backed graphite sheet material sold by GrafTech International, Ltd. As discussed further below, heat from the LEDs 404 is thermally coupled by metal core, FR4, or fiberglass board 422 to the anisotropic heat spreading material 414. In this embodiment and in other embodiments, the x-y plane is along the plane or surface of the luminaire or reflector 420 and the z direction is downwards into the luminaire. Depending on the embodiment, as would be understood by one of skill in the art, the anisotropic material can include isotropic material which is configured to provide anisotropic heat spreading. As seen in FIG. 5, x and y are in the plane of the page and z is into or out of the page. Thus, the heat spreading material 414 transfers the spread heat over a wider area of the luminaire 420 which in turn transfers heat to the ambient air. By anisotropically preferentially directing heat outwards away from the LEDs $\mathbf{404}_1$, $\mathbf{404}_2$, $\mathbf{404}_3$, and $\mathbf{404}_4$ as illustrated by arrows 405 of FIG. 6, effective heat dissipation is achieved by taking advantage of the large surface area of both the graphite sheet 414 and the luminaire fixture 420. Optionally, the material 414 may be covered with a polymer-based overfill material, which can be reflective, such as a reflective polyimide overfill material matching the color of the fixture 420.

FIG. 6 shows a cutaway bottom view of the portion of the fixture 400 seen in FIG. 5 and illustrates four LED $\mathbf{404}_1$, $\mathbf{404}_2$, $\mathbf{404}_3$ and $\mathbf{404}_4$ (collectively 404) and an arrangement in which the anisotropic heat spreading material 414 extends the length of the luminaire or reflector 420.

Figure 7:
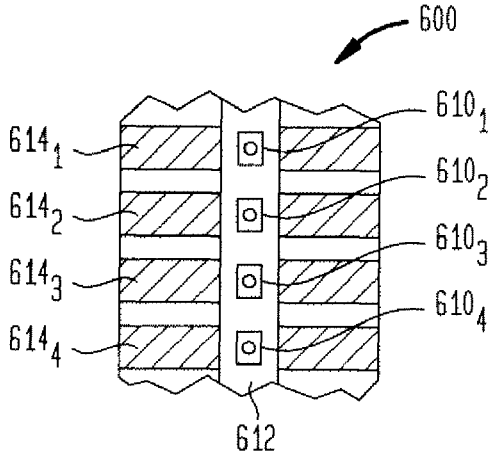
FIG. 7 illustrates a bottom view of an alternative embodiment employing anisotropic heat spreading strips.

FIG. 7 shows a cutaway bottom view of an alternative embodiment of a fixture 600 in which LEDs $\mathbf{610}_1$, $\mathbf{610}_2$ $\mathbf{610}_3$ and $\mathbf{610}_4$ (collectively 610) are thermally coupled by metal core or FR4 board 612 to individual strips $\mathbf{614}_1$, $\mathbf{614}_2$, $\mathbf{614}_3$ and $\mathbf{614}_4$ of anisotropic heat spreading material.

Figure 8:
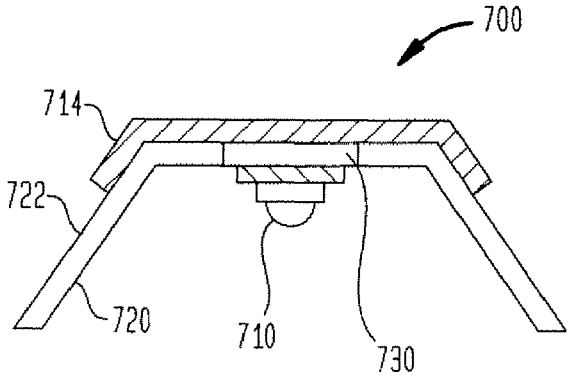
FIG. 8 shows an alternative embodiment in which an anisotropic heat spreading material is mounted on the back of a luminaire fixture.

FIG. 8 shows a lighting fixture 700 according to an alternative embodiment of the present invention in which LED 710 is mounted to a luminaire or reflector 720 having a sheet of anisotropic heat spreading material 714 attached to its back surface 722. In this embodiment, a copper via 730 or other thermal connections may be employed to more effectively transfer heat from LED 710 to the anisotropic material 714. The anisotropic material may extend the length of the back surface of fixture 720 as in FIG. 6 or may be installed in strips as in FIG. 7. In alternative embodiments, the anisotropic material can be in various shapes, such as rectangles, squares or circles about individual or groups of LEDs.

Figure 9A:
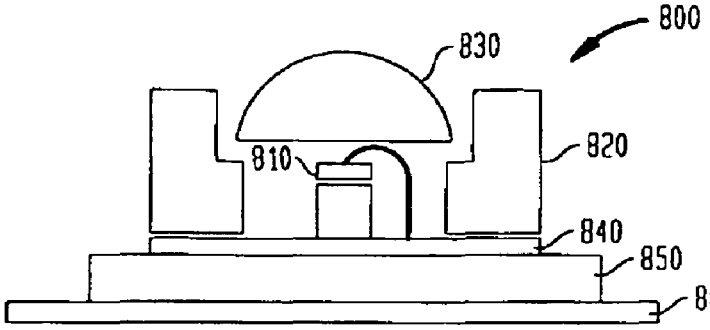
FIGS. 9A and 9B illustrate alternative LED mounting arrangements utilizing anisotropic material in accordance with the present invention.
Figure 9B:
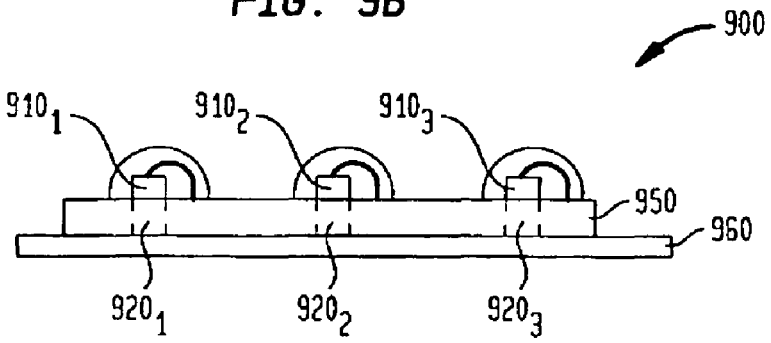

FIGS. 9A and 9B illustrate two different anisotropic heat spreading mounting arrangements 800 and 900. In the illustrative mounting arrangement 800, an LED chip 810 is mounted within a reflector cup 820 with an optical lens 830. This subassembly is mounted o a substrate 840 on a metal core printed circuit board (MCPCB). For further details of such mounting arrangements, see the documentation details of the XLamp™ series LED products of Cree, Incorporated, for example. In accordance with the present invention, an anisotropic heat spreading material 860 is added to the mounting arrangement.

FIG. 9B shows an alternative mounting arrangement 900 in which plural LEDs $\mathbf{910}_1$, $\mathbf{910}_2$, and $\mathbf{910}_3$ (collectively 910) are mounted directly on an MCPCB. Copper filled vias $\mathbf{920}_1$, $\mathbf{910}_2$ and $\mathbf{920}_3$, thermally connect the LEDs $\mathbf{910}_1$, $\mathbf{910}_2$, and $\mathbf{910}_3$, respectively, to anisotropic heat spreading material 960.

Figure 10:
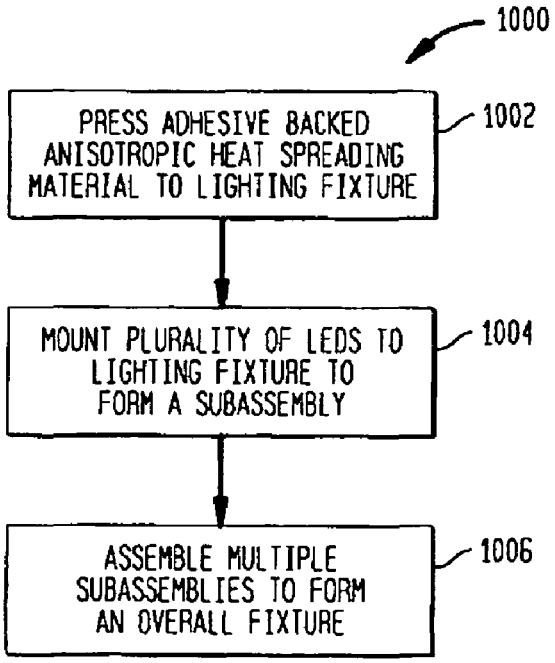
FIG. 10 shows a flowchart of a process of manufacturing a luminaire fixture in accordance with the present invention.

FIG. 10 shows details of a process 1000 of making a lighting fixture employing anisotropic heat spreading in accordance with the present invention. Process 1000 is an exemplary process of manufacturing a retrofit lighting fixture employing high power lighting LEDs to replace an existing fluorescent bulb fixture with a unit having a similar profile and footprint. In step 1002, a standard luminaire fixture without ballasts of fluorescent bulb sockets has an adhesive back strip of anisotropic heat spreading material pressed in place as shown in FIGS. 5 and 6, for example. Alternatively strips, such as strips $\mathbf{614}_1$, $\mathbf{614}_2$, $\mathbf{614}_3$ and $\mathbf{614}_4$ of FIG. 7 may be applied or material 714 may be applied as discussed above in connection with FIG. 8. As a further alternative and while not presently preferred, the surface of an aluminum or other fixture may be suitably prepared and the anisotropic graphite or another anisotropic material may be directly applied on that surface.

In step 1004, a plurality of LEDs are mounted on the anisotropic material so that good thermal contact is made and heat is efficiently transferred from the LEDs to the anisotropic material. The LEDs may be individually mounted or may be mounted as part of a subassembly of plural LEDs.

In step 1006, plural subassemblies are assembled into an overall fixture, such as the fixture 400 of FIG. 4. Preferably the final fixture has a comparable weight, profile and footprint to fluorescent lighting fixture.

Figure 11:
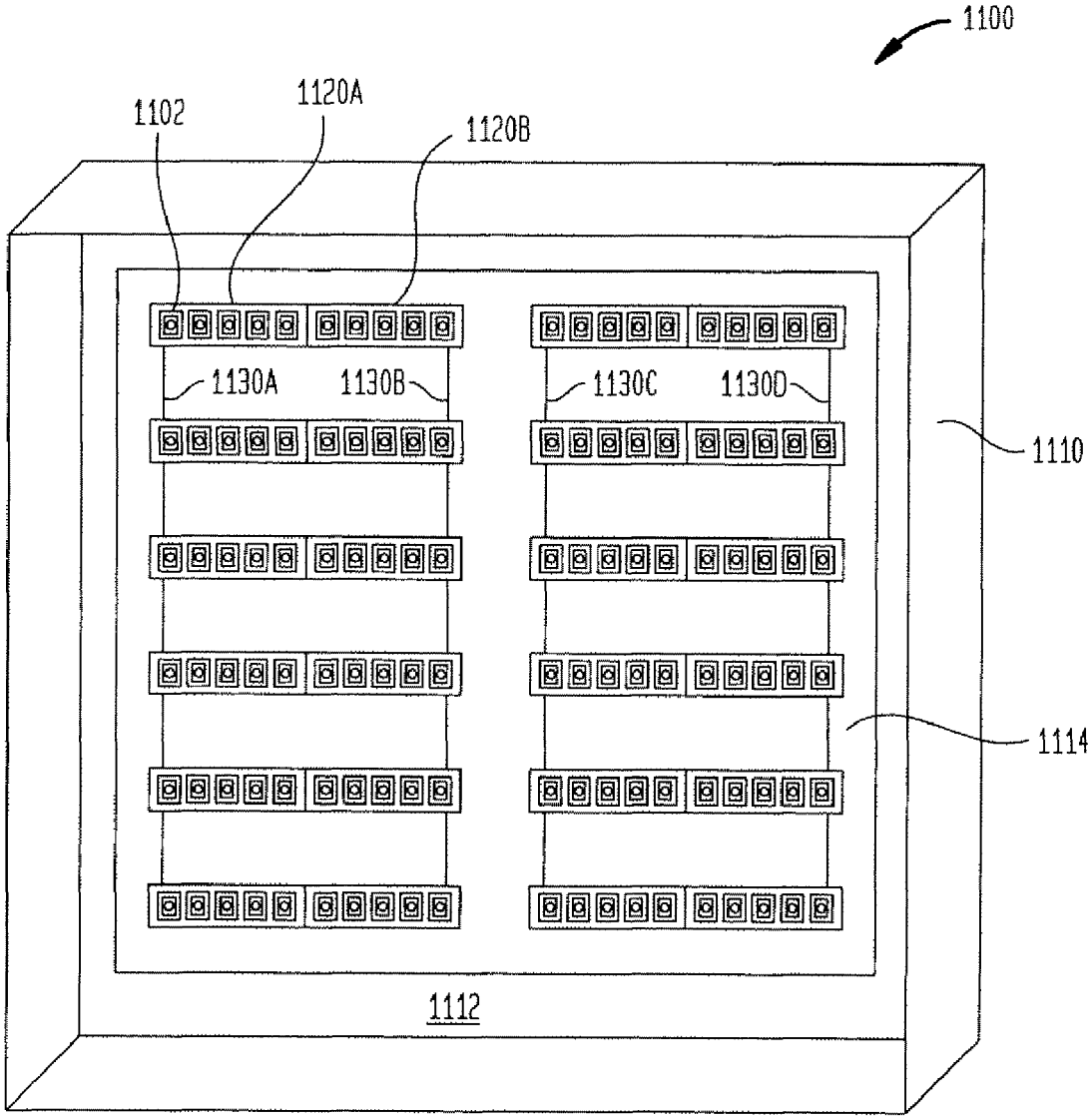
FIG. 11 illustrates a perspective view of a further embodiment of the invention.

While the above discussion has focused primarily upon the application of the present invention to the retrofitting, of existing lighting fixtures, such as standard fluorescent luminaire fixtures, and the like, by replacing fluorescent bulbs and their associated hardware with LEDs and utilizing efficient heat spreading techniques as taught herein, it will be recognized that the present invention is also applicable in a wide variety of other contexts in which it is desired to provide an LED based lighting fixture with improved heat dissipation characteristics. As one example, FIG. 11 shows a bottom view of a 2'×2' light emitting diode (LED) lighting package 1100 in accordance with the present invention. The LED lighting package 1100 includes a housing or compartment 1110 of a thermally conductive material such as aluminum. The housing 1110 has a backing 1112 and may suitably be a pressed or otherwise formed sheet of aluminum with a thickness of approximately 1/16 inch. It should be noted that other materials and approaches to providing heat dissipation may also suitably be employed, for example, U.S. patent application Ser. Nos. 11/379,709 and 11/379,726, entitled "Light Emitting Diode Packages" and "Light Emitting Diode Lighting Package with Improved Heat Sink", respectively, both filed Apr. 21, 2006, describe additional packages and backing structures and are incorporated by reference herein in their entirety.

Also, it is recognized that other thermally conductive materials such as ceramics, plastics, and the like may be utilized. Aluminum is presently preferable because of its abundance and relatively low cost. The LED lighting package 1100 includes columns of LEDs mounted on printed circuit boards (PCBs) such as PCB 1120A and 1120B. Each PCB has five LEDs such as LED 1102 mounted thereon and these LEDs are electrically connected in series with each other. Each PCB includes a positive voltage terminal and a negative voltage terminal (not shown). The negative voltage terminal of PCB 1120A is electrically connected to the positive voltage terminal of PCB 1120B so that the ten LEDs defining a column are electrically serially connected. It should be recognized that although two PCBs are shown to construct one column of LEDs, a single PCB may be utilized for a particular column of LEDs. The columns of ten LEDs are electrically connected in parallel to its adjacent column by wires 1130A-D, respectively. In accordance with the present invention, an anisotropic heat spreading material is employed either between the front of backing 1112 and the PCBs or on the back of the backing 1112 so that heat from the LEDs, such as LED 1102, is more effectively transferred to a larger volume of the aluminum of the housing than would occur without the preferential spreading.

While the present invention has been disclosed in the context of various aspects of presently preferred embodiments, it will be recognized that the invention may be suitably applied to other environments consistent with the claims which follow. For example, while the present invention has been described in the context of several presently preferred embodiments with a focus upon thin sheets of anisotropic graphite, other heat spreading materials may be utilized both which exist today and which may be developed or become more cost effective in the future. As an example, it is contemplated that thin copper plates with micro and nano liquid channels, such as those formerly sold by iCurie, now Celsia Technologies, may be suitably employed in place of or in addition to the anisotropic graphite sheets. Further while the present discussion has centered upon the retrofitting or replacement of standard fluorescent lighting fixtures because those fixtures are amongst the most commonly utilized today, the present teachings may also be applied to any lighting fixture, including incandescent fighting fixtures, that can be retrofitted or designed with lighting LEDs including without limitation street lights, low bay lights, desk lamps or the like.

I claim:

1. Solid state room lighting fixture comprising:

a thermally conductive reflector having a planar portion flush mountable on a ceiling of a room;

a solid state light source mounted on the planar portion relative to the reflective surface whereby the reflective surface reflects light from the solid state light source downwardly;

a thermally anisotropic heat spreader preferentially conducting heat in an x-y plane parallel the planar portion as opposed to in a z-direction perpendicular to the x-y plane, the x-y plane of the thermally anisotropic heat spreader in thermal contact with the solid state light source and in thermal and physical contact over part of the planar portion of the thermally conductive reflector of the lighting fixture so as to spread heat from the solid state light source preferentially in a direction parallel to the planar portion of said thermally conductive reflector thereby making said thermally conductive reflector and the thermally anisotropic heat spreader collectively a more effective combined heat sink for the solid state light source by spreading heat from the solid state light source to a wider area of the thermally conductive reflector.

2. The solid state lighting fixture of claim 1 further comprising a plurality of high power solid state light sources capable of providing ambient room lighting.

3. The solid state lighting fixture of claim 2 wherein said plurality of high power solid state light sources comprises a plurality of high power light emitting diodes (LEDs) having a current of at least 125 mA.

4. The solid state lighting fixture of claim 3 wherein said plurality of high power LEDs are mounted so that at least one sheet of anisotropic graphite spreads the heat from all of said plurality of high power LEDs.

5. The solid state lighting fixture of claim 4 wherein said reflector comprises an aluminum box shaped reflector having a top with a top surface flush mountable with the ceiling and said at least one sheet of anisotropic graphite is pressed on an underside of the top.

6. The solid state light fixture of claim 4 wherein said reflector comprises a luminaire and said at least one sheet of anisotropic graphite is pressed on an overside of a top surface of the luminaire.

7. The solid state lighting fixture of claim 6 wherein a heat conductive via thermally connects the high power LEDs mounted on an underside of the top surface to said at least one sheet of graphite pressed on the overside.

8. The solid state lighting fixture of claim 1 wherein said reflector is a box-shaped aluminum fixture.

9. The solid state lighting fixture of claim 3 wherein said plurality of high power LEDs are mounted parallel to a longitudinal axis of the solid state lighting fixture and each one of said plurality of high power LEDs has a corresponding strip of anisotropic graphite to direct its heat preferentially in a direction substantially perpendicular to the longitudinal axis of the solid state lighting fixture.

10. The solid state lighting fixture of claim 5 wherein said single sheet of anisotropic graphite is covered with a polymer-based overfill having a color matching that of said reflector.

11. The solid state lighting fixture of claim 1 wherein the anisotropic heat spreader spreads heat better in the x-y plane by a factor of at least five times than in the z direction perpendicular to the plane.

12. The solid state lighting fixture of claim 1 wherein said thermally conductive reflector is aluminum.

13. The solid state lighting fixture of claim 12 wherein the aluminum reflector has a thermal conductivity of approximately 205-220 W/m-K at room temperature.

14. The solid state lighting fixture of claim 13 wherein the anisotropic heat spreader is a sheet material thermally adhered to the thermally conductive component and has a thermal conductivity in the x-y plane of at least twice that of the aluminum reflector.

15. A solid state lighting subassembly of a room lighting fixture, the solid state lighting subassembly comprising:

a thermally isotropic reflector having a reflective surface, said reflector having a planar portion flush mounted on a planar mounting surface, the thermally isotropic reflector also having angled reflective wing surfaces;

a plurality of light emitting diodes mounted on the planar portion and relative to the reflective surface whereby the reflective surface reflects light from the plurality of light emitting diodes to provide room lighting;

and a thermally anisotropic material preferentially conducting heat in an x-y plane parallel the planar portion as opposed to a z-direction perpendicular to the x-y plane, the thermally anisotropic material in physical contact with the planar portion of the thermally isotropic reflector and in thermal contact with both the plurality of LEDs and the planar portion of the thermally isotropic reflector and thermally conducting heat from said plurality of LEDs to the thermally isotropic reflector to more effectively utilize a large area of said reflector as a heat sink.

16. The solid state lighting subassembly of claim 15 wherein said mounting material comprises aluminum.

17. The solid state lighting subassembly of claim 15 wherein said anisotropic material is a sheet of anisotropic graphite.

18. The solid state lighting subassembly of claim 15 wherein said plurality of LEDs have a current of at least 125 mA.

19. The solid state lighting subassembly of claim 15 wherein said thermally anisotropic material is a sheet adhered to the planar portion, and said anisotropic material has a thermal conductivity in the plane of the sheet which is at least a factor of five times greater than its thermal conductivity in a direction perpendicular to said plane.

20. The solid state lighting subassembly of claim 15 wherein the planar mounting surface is a part of a housing of the lighting fixture.

* * * * *